United States Patent [19]

Cole et al.

[11] Patent Number: 4,959,512

[45] Date of Patent: Sep. 25, 1990

[54] APPLIANCE TIMER WITH IMPROVED TERMINAL ASSEMBLY

[75] Inventors: Ronald E. Cole, Greenwood; Daniel K. Amonett; Steven W. Smock, both of Indianapolis, all of Ind.

[73] Assignee: Emhart Industries Inc., Towson, Md.

[21] Appl. No.: 330,159

[22] Filed: Mar. 29, 1989

[51] Int. Cl.[5] ..... H01H 43/10; H01H 1/58; H01R 9/00; H01R 29/00

[52] U.S. Cl. ..... 200/38 R; 200/38 B; 200/38 C; 361/426; 439/189

[58] Field of Search ..... 200/35 R, 38 R, 38 A, 200/38 B, 38 BA, 38 C, 38 CA; 74/568 R, 568 T, 568 M; 439/45, 189; 29/876

[56] References Cited

U.S. PATENT DOCUMENTS

| | | | |
|---|---|---|---|
| 3,390,243 | 6/1968 | Obermann | 200/38 B X |
| 3,771,102 | 11/1973 | Murray et al. | 200/283 X |
| 3,809,831 | 5/1974 | Godwin et al. | 200/38 C |
| 3,857,293 | 12/1974 | Godwin et al. | 74/568 T X |
| 4,381,430 | 4/1983 | Smock et al. | 200/35 R |
| 4,517,426 | 5/1985 | Edwards et al. | 200/38 A |
| 4,567,654 | 2/1986 | Kloenne et al. | 29/876 |

*Primary Examiner*—J. R. Scott

*Attorney, Agent, or Firm*—Edward D. Murphy

[57] ABSTRACT

An appliance timer includes a motor-driven cam, a plurality of electrical switches responsive to the cam, and a plurality of electrical terminals electrically connected to the switches, all of which are supported in a housing. The terminals are arranged on one end of the housing in n rows, and bussing between the terminals is provided so that all terminals to which external electrical connection is to be made are in one of m rows, with m being less than n. An insulating maze structure is provided in the housing within which the terminals are mounted so that the air path distance between terminals connected to differing electrical polarities is greater than the straight line path. The terminals to be connected to are longer than the other terminals. A terminal cover is snapped onto the housing and covers all of the terminals in the rows other than the m rows while leaving the longer terminals in the m rows exposed for connection to an external connector.

10 Claims, 14 Drawing Sheets

FIG. 5A
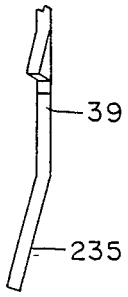
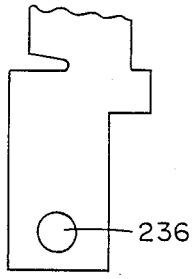
FIG. 5B
FIG. 6
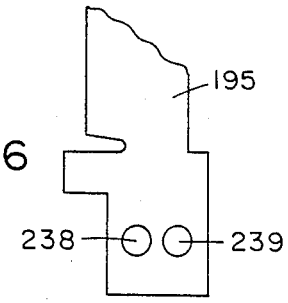
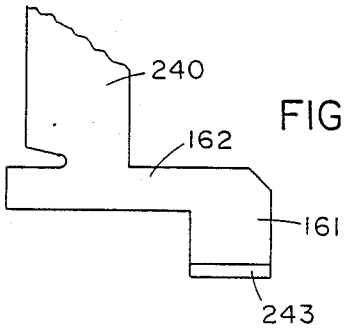
FIG. 7
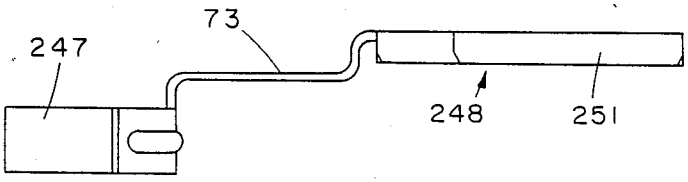
FIG. 8A
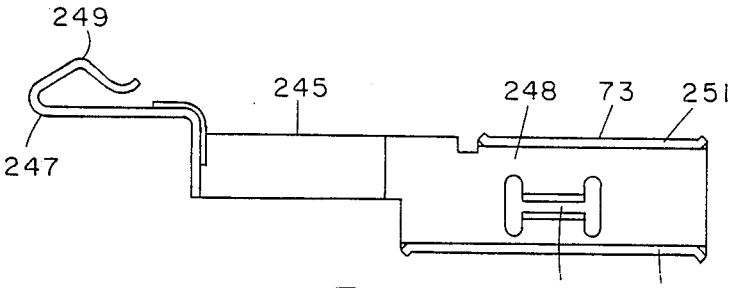
FIG. 8B

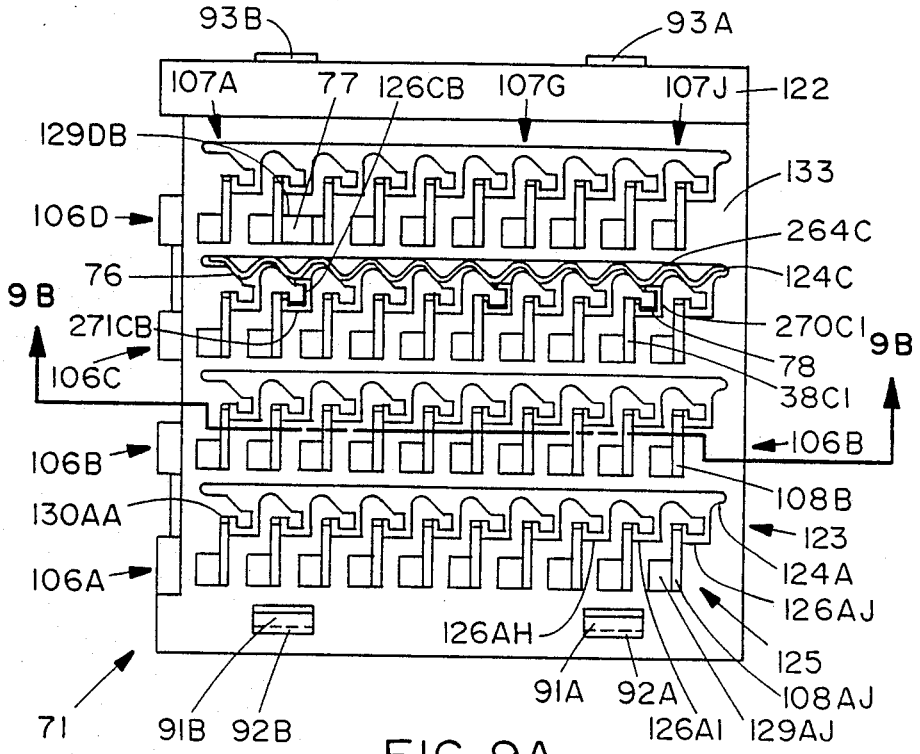
FIG. 9A
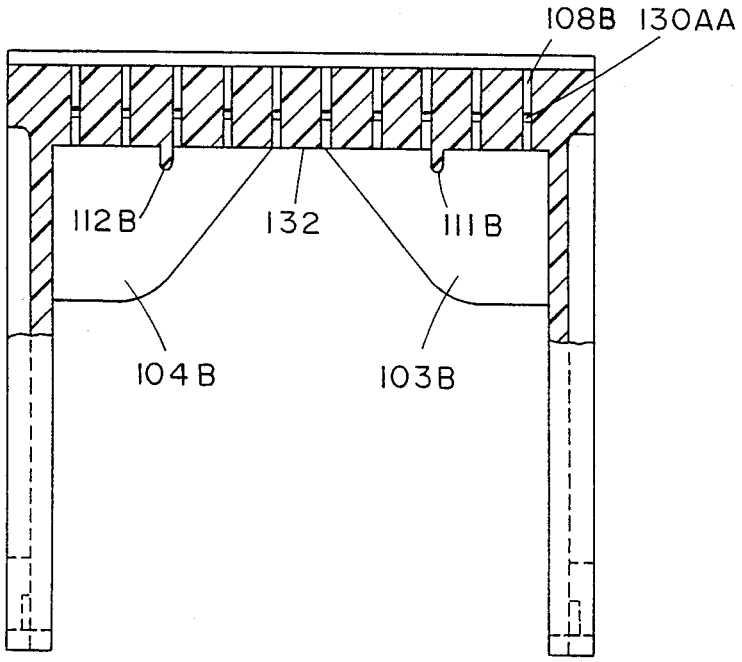

APPLIANCE TIMER WITH IMPROVED TERMINAL ASSEMBLY

BACKGROUND OF THE INVENTION

1. Field of the Invention

The invention in general relates to appliance timers, and in particular to a dryer timer.

2. Description of the Related Art

Electromechanical timers have been used to provide programmed control of appliance functions for more than half a century. Such timers generally comprise a motor driven cam and electrical switches responsive to the cam for controlling the appliance functions, the cam and switches being mounted in a timer housing. Electrical terminals connected to the switches extend from the housing. FIG. 1 of U.S. Pat. No. 4,381,430 on an invention of Steven W. Smock and George W. Adams shows the general state of the art of the terminal assembly in a dryer timer. The terminals are arranged in several groups, with the groups and the individual terminals in each group relatively widely spaced. This is because some dryer timer terminals must carry very large power loads in order to power the dryer heater. Connections to such widely spaced terminals are generally by way of individual connectors and wires assembled in a wiring harness. In contrast, the terminals in a washer timer are generally grouped together in a connector block. See for example U.S. Pat. Nos. 4,567,654 on an invention of Ernest F. Kloenne and Garry A. Stout; 4,517,426 in the names of James D. Edwards and Charles Malone; 3,857,293 and 3,809,831 in the names of George A. Godwin and William E. Wagle; 3,771,102 on an invention of Stephen F. Murray and Harold T. Simmons; and 3,390,243 in the name of George Obermann. While all of the terminal arrangements in these washer timers permit electrical connection to be made more easily than in the state-of-the-art dryer timer, they all require rather bulky connectors, and in some, portions of the electrical circuits and/or connections remain exposed even after all connections are made, which could lead to undesired electrical contact, which could be especially serious in a dryer timer.

SUMMARY OF THE INVENTION

It is an object of the invention to provide an appliance timer in which the electrical terminals are all in a single terminal block, the number of individual terminals within the block are minimized, and all parts of the timer circuit and electrical connectors are covered when connection is made to a relatively small connector.

It is another object of the invention to provide the above object in a dryer timer.

It is a further object of the invention to provide one or more of the above objects in a timer that is relatively inexpensive to manufacture.

It is another object of the invention to provide one or more of the above objects in a timer that is more reliable than prior art timers.

The invention provides an appliance timer comprising: a motor-driven cam; electrical switches responsive to the cam; a plurality of electrical terminals, at least one of which is electrically connected to at least one of the switches; housing means for supporting the cam, the switches, and the terminals; the terminals defining n rows of terminals where n is 2 or more, each row having at least one terminal in it, and m of the rows of terminals containing a plurality of longer terminals which extend further from the housing in a predetermined direction than terminals in the other rows of the terminals, m being less than n and at least one; and cover means for covering the other rows of terminals while leaving the longer terminals in the m rows exposed. Preferably, the cover means comprises a first portion enclosing the other terminals and an extension extending around the periphery of the m rows and having an open end. Preferably, the timer includes key means for permitting a connector to be connected to the extension in only one orientation, and bussing means for connecting selected ones of the terminals, and the cover means comprises means for covering the bussing means. Preferably, n is equal to 3 or more and m equals 1 or 2.

In another aspect the invention provides a method of manufacturing an appliance timer comprising the steps of: providing a timer comprising a motor-driven cam, electrical switches responsive to the cam, a plurality of electrical terminals at least one of which is electrically connected to at least one of the switches, and housing means for supporting the cam, the switches, and the terminals, the terminals extending from the housing and defining n rows of terminals with m rows containing a plurality of longer terminals which extend further from the housing in a predetermined direction than terminals in the other rows of the terminals, m being less than n and at least one; and covering the terminals in the other rows while leaving the longer terminals in the m rows exposed for connecting to an external connector. Preferably, before the step of covering the method further includes the steps of: providing a maze of standing insulator such that all air paths between terminals and conductors connecting the terminals which are not connected to each other will be at least 3 mm in length; and electrically connecting selected ones of the terminals that are not the longer terminals to selected ones of the longer terminals in said m rows by inserting conductors in the maze.

The timer according to the invention not only provides easier and safer connections to a timer and increased reliability, but the timer is also more compact than prior art timers which is highly advantageous considering the crowded control areas of present-day appliances. Numerous other features, objects and advantages of the invention will become apparent from the following detailed description when read in conjunction with the accompanying drawings.

BRIEF DESCRIPTION OF THE DRAWINGS

FIGS. 5A and 5B are edge and broad-side views of a portion of a combination terminal and short switch blade;

FIG. 6 is a broad-side view of a terminal to which a long switch blade may be attached;

FIG. 7 is a broad-side view of a motor terminal;

FIGS. 8A and 8B are side and front views respectively of a motor electrical connector;

FIGS. 9A, 9C and 9D are top, bottom and side views respectively of the timer housing body of FIG. 1;

FIG 9B is a cross-sectional view taken through the line 9B—9B of FIG. 9A;

DESCRIPTION OF THE PREFERRED EMBODIMENT

Figure 1A:
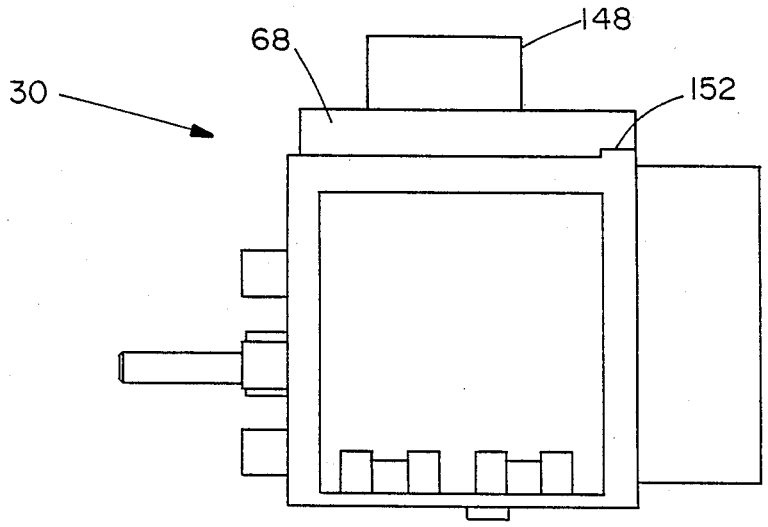
FIGS. 1A, 1B, and 1C are side, top and front views respectively of a preferred embodiment of a timer according to the invention.
Figure 1B:
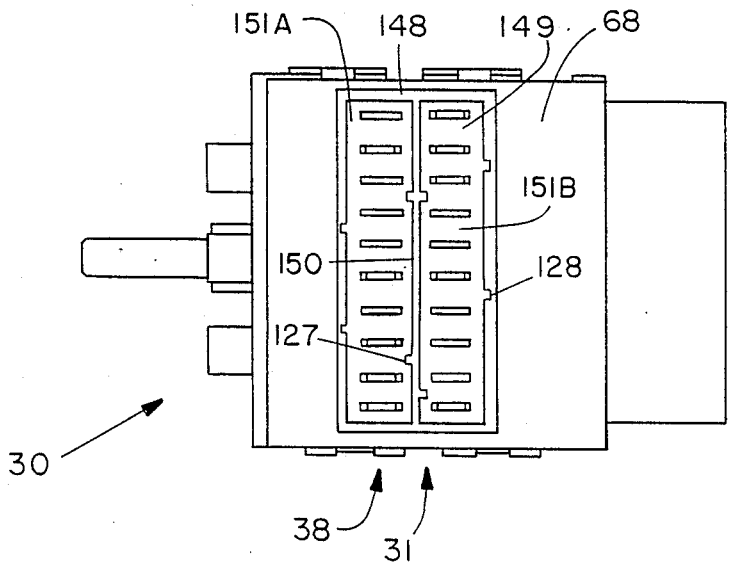
Figure 1C:
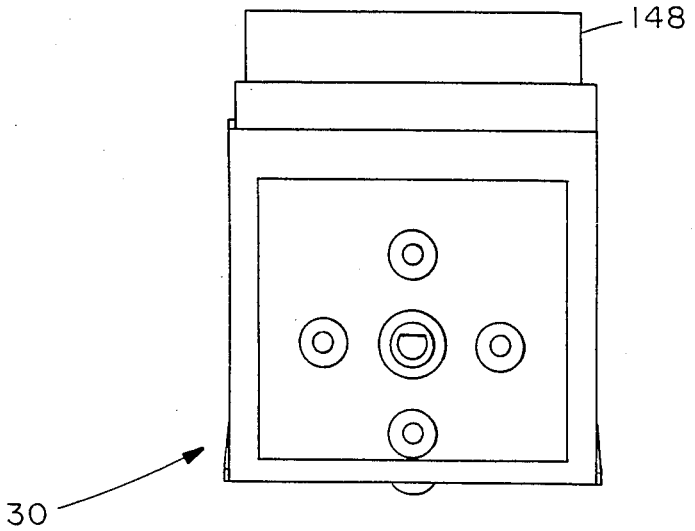

In FIGS. 1A through 20, a preferred embodiment of an electromechanical timer according to the invention is shown. Another preferred embodiment is shown in FIGS. 21 through 24. It should be understood that these embodiments are intended only to be examples of the invention, are shown only to illustrate the invention, and are not intended to limit the invention to their particular details.

Turning to FIGS. 1A, 1B and 1C and FIG. 2, a brief review of the invention will first be given to orient the reader. When the words "front", "left", "right", "back", and "bottom" are used in the discussion below to refer to the timer, they are in reference to the view shown in FIG. 2 unless otherwise specified. The preferred embodiment 30 of the timer according to the invention includes a motor-driven cam means 40, a plurality of electrical switches 35 responsive to the cam means 40, and a plurality of electrical terminals 38 connected to the switches 35. The terminals 38 may be long, such as 37, or short, such as 39, and pass through the closed end 33. The terminals 38 are organized into an array of four rows 106A through 106D of terminals. Electrical busses within closed end 33 and bussing block 66 (FIGS. 9A and 15A) are arranged so that all terminals to which external electrical connection is to be made are in the two middle rows 106B and 106C. Cover 68 fits over the top of closed end 33 and bussing block 66 and covers the rows 106A and 106D of short terminals while leaving the long terminals in the rows 106B and 106C exposed (FIG. 1B) for connection to a female electrical connector (not shown).

Turning now to a more detailed description of the invention, the timer 30 comprises a timer housing 31, cam 56, camshaft 50, two-way clutch 64, motor 42, switches 35, terminals 38, bussing block 66, and terminal cover 68. Housing 31 comprises housing body 32, motor housing 43, front panel 48, and base-plate 70. The timer also includes motor electrical connectors 73 and 74 (FIGS. 8A and 8B), and electrical busses such as 76, 77, 78 and 79 (FIGS. 11–14), which are not shown in detail in FIG. 2 because the scale is too small.

Figure 9C:
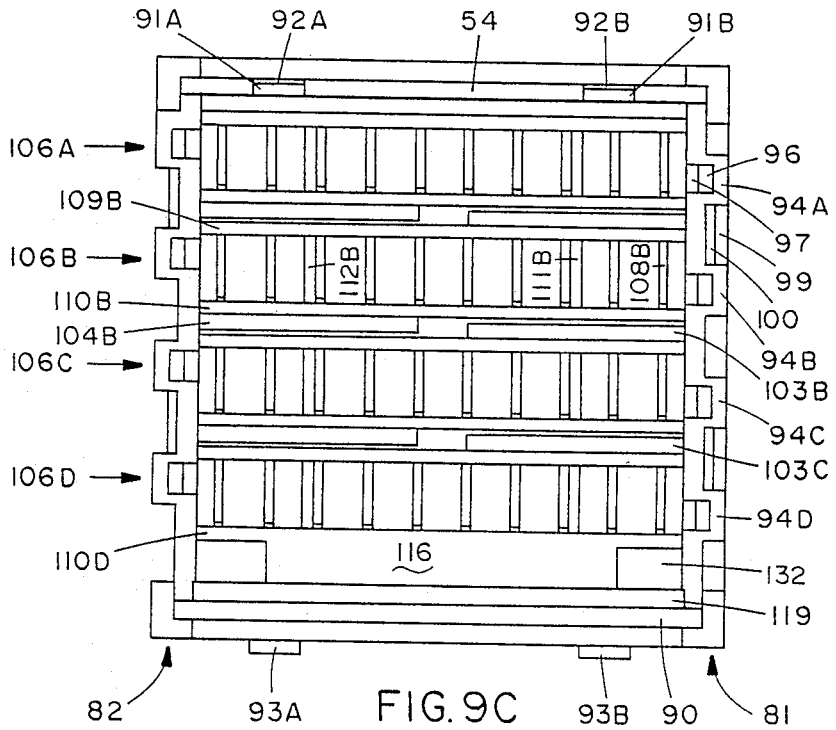
Figure 9D:
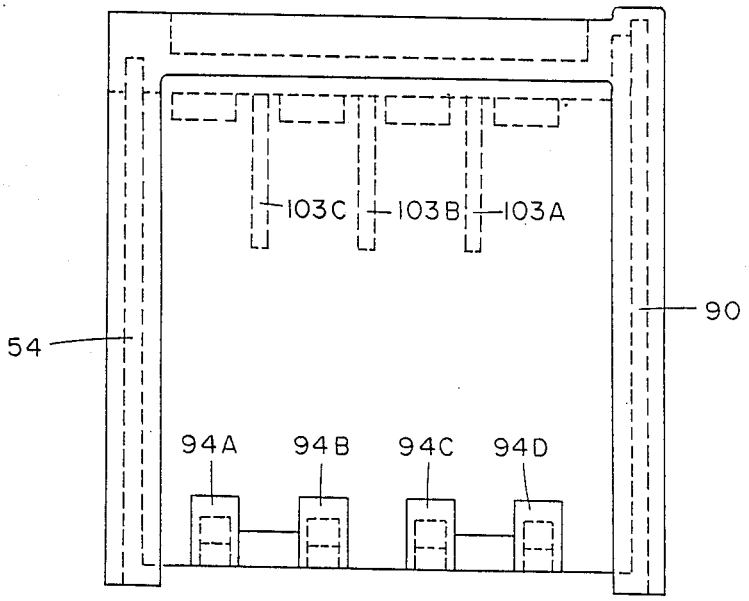
Figure 10A:
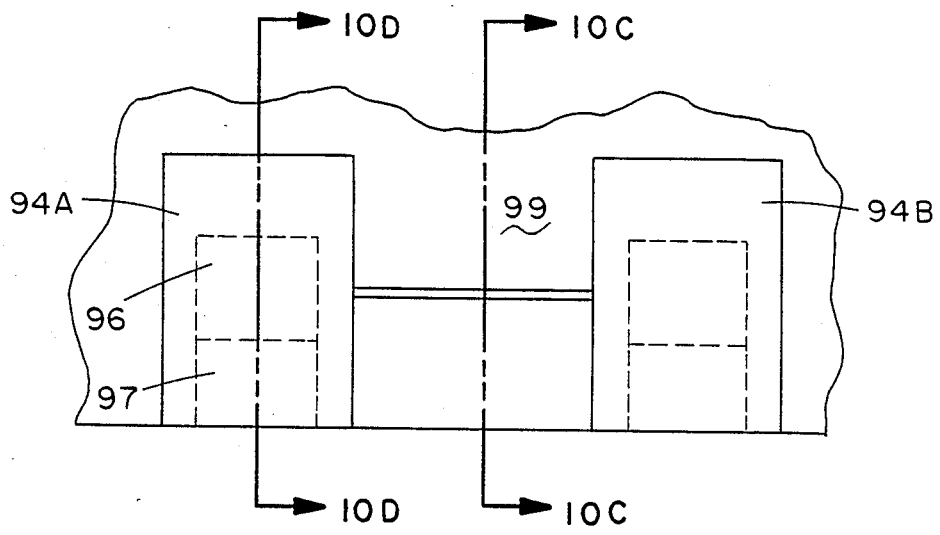
FIGS. 10A and 10B are expanded side and bottom views respectively of the snap-in sockets of the housing of FIG. 1.
Figure 10B:
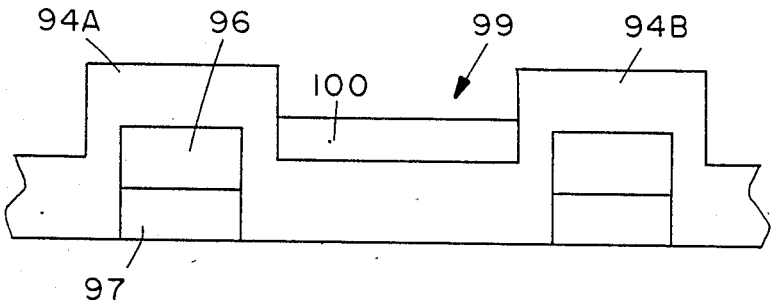
Figure 10C:
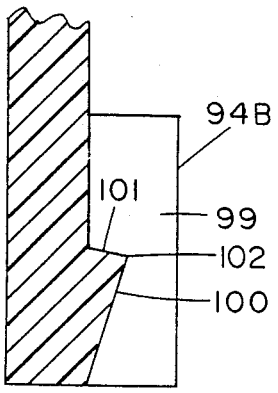
FIGS. 10C and 10D are cross-sections taken through lines 10C—10C and 10D—10D respectively of FIG. 10A.
Figure 10D:
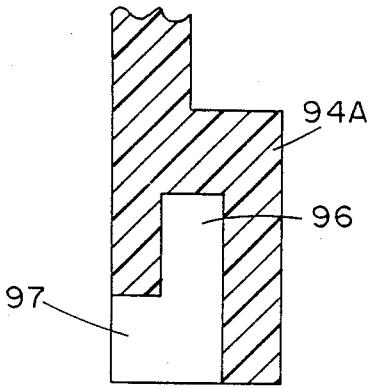
Figure 11:
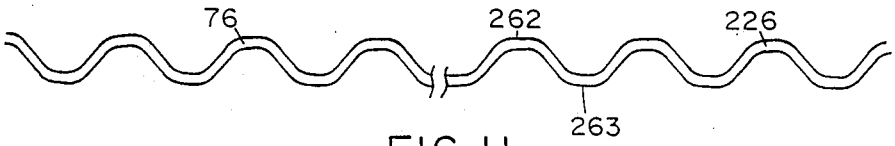
FIG. 11 is a narrow-side view of a corrugated electrical (first) bus for use with the maze of FIGS. 9A and 9E.
Figure 12A:
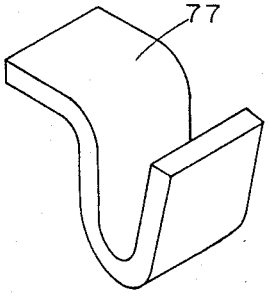
FIGS. 12A and 12B are perspective and side views respectively of a terminal connector bus for use with the maze of FIGS. 9A and 9E.
Figure 12B:
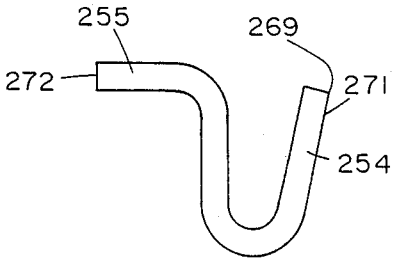
Figure 13A:
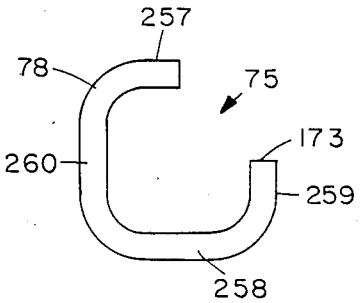
FIGS. 13A and 13B are thin-side and broad-size views respectively of a c-shaped (second) electrical bus for use with the maze of FIGS. 15A and 15C.
Figure 13B:
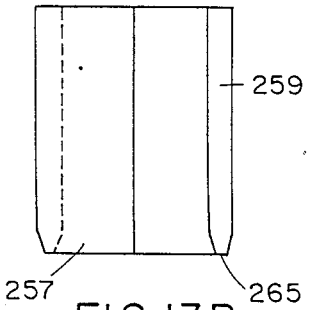

Housing body 32 preferably comprises a u-shaped member 32 having two leg portions 81 and 82, and a connecting portion 84 which forms the closed end 33. Leg portions 81 and 82 define first open side 86 and second open side 87. There is a groove 54 adjacent the open side 86 and another groove 90 (FIG. 9D) adjacent open side 86. A pair of rectangular channels (FIGS. 9A and 9C) 91A and 91B each having a lip 92A and 92B are formed in the top front edge of housing body 32 and a pair of catches 93A and 93B extend from the top back edge of the housing body 32. At the bottom edge of leg 81, four studs 94A, 94B, 94C and 94D (FIGS. 9C and 9D) are formed. The detail of the structure of these studs and the area between them is shown in FIGS. 10A through 10D, with FIG. 10A being an expanded view of the lower leftside of FIG. 9D, FIG. 10B being an expanded view of the upper right side of FIG. 9C, and FIGS. 10C and 10D being sections as shown in FIG. 10A. Stud 94A has a recess 96 formed in it and a slot 97 connecting the recess 96 and the interior of the housing body 32. Each of the studs 94B through 94D have a similar construction. A channel 99 is formed between studs 94A and 94B. A ramp 100 having a lip 101 extends into the channel 99. A similar channel and ramp are formed between studs 94C and 94D. The bottom of leg 82 has the similar structure as the bottom of leg 81. The interior top end of housing body 32 has six ribs 103A through 103C and 104A through 104C formed on it. The ribs 103A through 103C attach to leg 81 and the ribs 104A through 104C attach to leg 82. All of the ribs also attach to the interior of closed end 33. Ribs 103B and 104 are shown in detail in FIG. 9B. The other four ribs are identical.

The timer 31 has four rows, 106A through 106D, of slots, terminals, and associated structures. The structure of these rows in the bottom or interior side 132 of closed end 33 is shown in FIGS. 9B and 9C. Only one row, 106B, will be described in detail, since the others are identical. Row 106B comprises a row of 10 slots, such as 108B, and having grooves, 109B and 110B on either side of the row of slots. The third slot from each of legs 81 and 82 each has a flange 111B and 112B respectively formed adjacent the slot on the side of the slot nearest the leg and extending parallel to the legs 81 and 82. As can best be seen in FIG. 9C, the studs 94A through 94D, recesses 96, slots 97, and ribs, such as 103B, on leg 81 are shifted toward the back of the housing body 32 (the lower side in FIG. 9C) with respect to the rows 106A through 106D while the corresponding structures on leg 82 are shifted toward the front. This is to accommodate the structure of the cams, such as 56. The cams, such as 56, are dual cams with one set of lobes along the front of each cam and another along the rear. As will be seen below, this shifted structure of the housing body 32 permits the sets of front cam lobes to drive the switches attached to leg 82 while the back sets of cam lobes drive the switches attached to leg 81. Groove 110D is extended into the channel 116 (FIG. 9C) in the bottom surface 132 of closed end 33 to permit the motor terminal busses to pass to the motor housing. The surface 132 is also recessed at 119 to receive rim 120 of the motor housing 43.

Figure 9E:
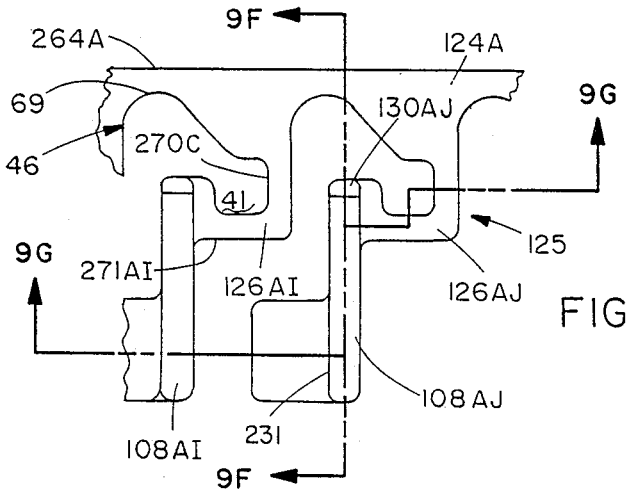
FIG. 9E is an extended view of a portion of the maze of the housing of FIG. 9A.
Figure 9F:
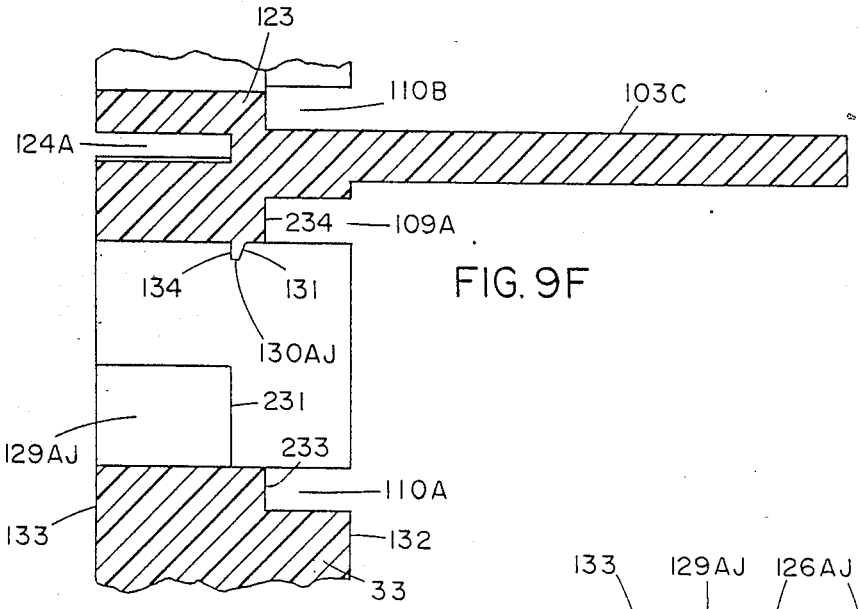
FIGS. 9F and 9G are cross-sections taken through the lines 9F—9F and 9G—9G respectively of FIG. 9E.
Figure 9G:
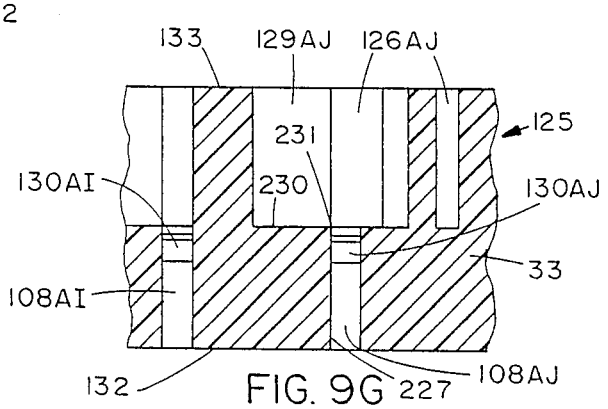

Turning to the structure of the top of closed end 33, this is best seen in FIG. 9A, with details shown in FIGS. 9E, 9F and 9G. The top exterior of housing body 32 has a rim 122 that rises slightly above the surface 133 and provides a key for bus block 66 and terminal cover 68. The surface 133 has four rows 106A through 106D and ten columns 107A through 107J of terminal slots, such as 108B, and associated structure. Considering row 106A, this structure comprises first insulating means 123 defining a first channel 124A and second insulating means 125 defining ten second channels, such as 126AI, 126AJ, 126AH, etc. Ten cavities, such as 129AJ, are also formed in surface 133 in this row each communicating with one of the slots, such as 108AJ. In FIG. 9E, the lower right corner of FIG. 9A is reproduced in expanded scale for clarity. FIGS. 9F and 9G show cross sections of the portion to further elucidate the structure. Prior to assembly of the timer, a crush bump, such as 130AJ, is located in each slot, such as 108AJ. Another crush bump is indicated at 130AA in FIG. 9A. The crush bumps are crushed upon insertion of the terminals 38 and provide a means for absorbing tolerance variations in the vertical direction in FIG. 9E. Each of the second channels, such as 126AJ, connect one of the first channels, such as 124A, with one of the slots, such as 108AJ.

As best seen in FIGS. 9F and 9G, the slots, such as 108AJ, pass entirely through closed end 33, the groves, such as 109A and 110A, formed in the under surface 132, pass about ⅓ of the way through the end 33, and the first channels, such as 124A, the second channels, such as 126AJ, and the cavities, such as 129AJ, formed in the upper surface 133, pass about ½ the way through the end 33. The crush bumps, such as 130AJ, are tapered on their lower surfaces, such as 131, and their upper surfaces, such as 134, are perpendicular to the wall of the slot.

Figure 15A:
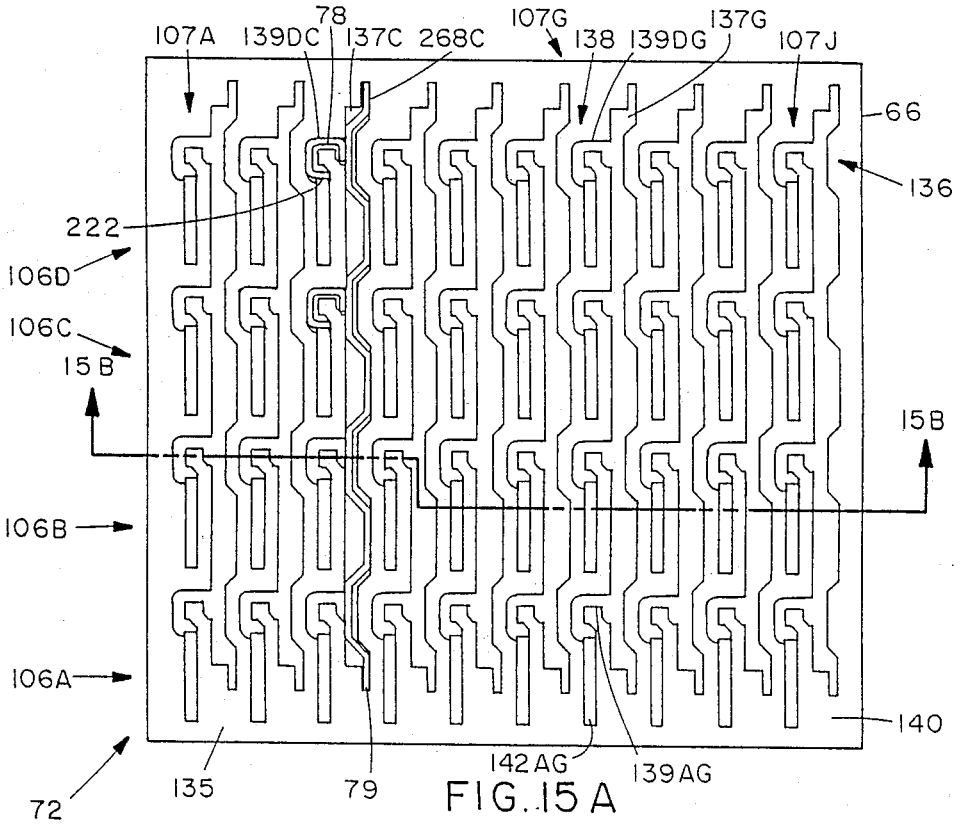
FIG. 15A is a top view of the bussing block of the timer of FIG. 1.
Figure 15B:
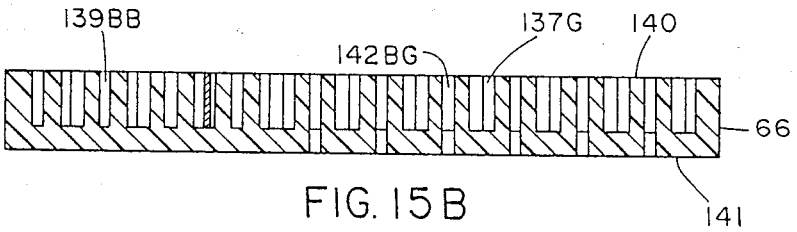
FIG. 15B is a cross-sectional view taken through the line 15B—15B of FIG. 15A.
Figure 15C:
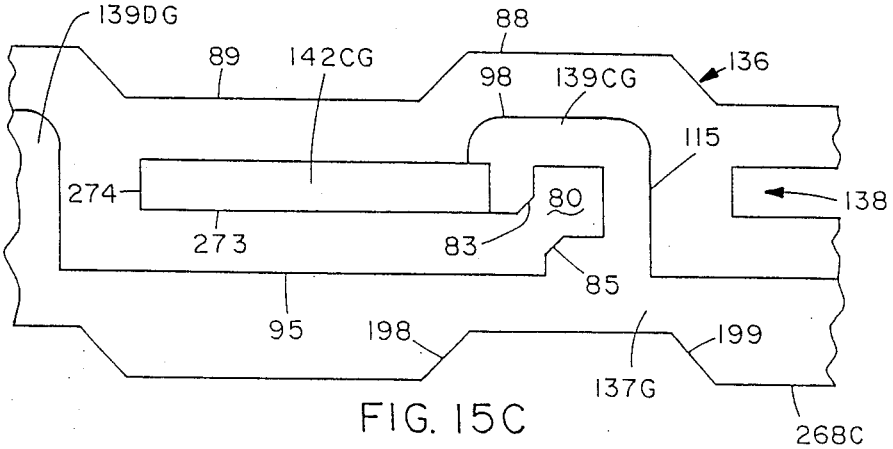
FIG. 15C is an expanded view of a portion of the maze of FIG. 15A.
Figure 16A:
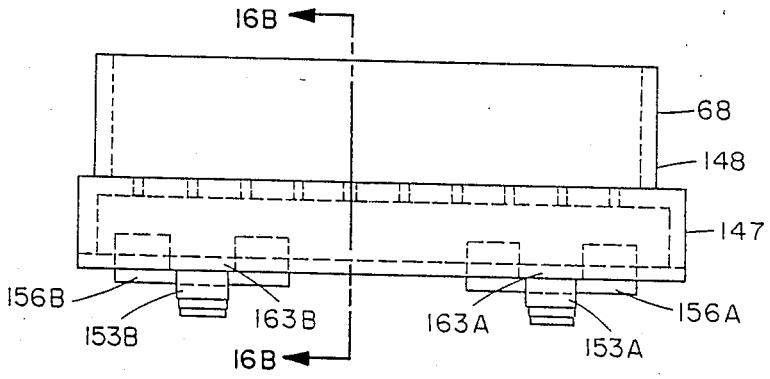
FIG. 16A is a front view of the terminal cover of the timer of FIG. 1.
Figure 16B:
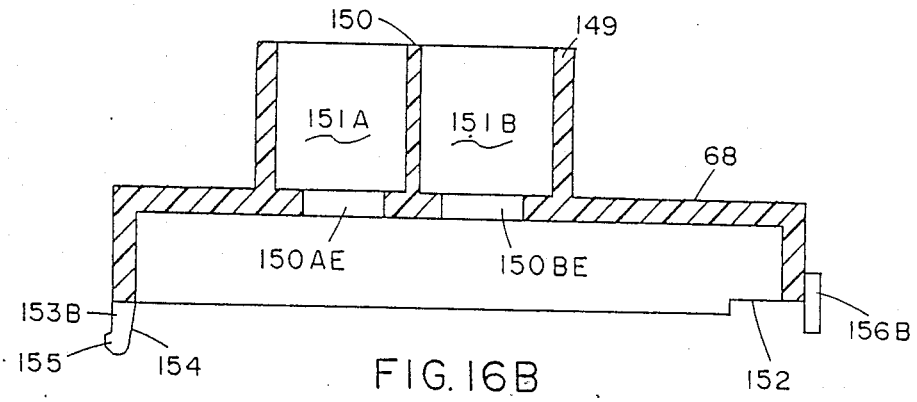
FIG 16B is a cross-sectional view taken through line 16B—16B of FIG. 16A.
Figure 17:
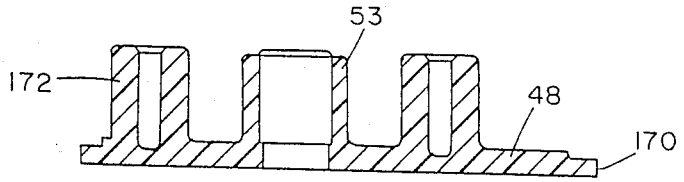
FIG. 17 is a cross-sectional view of the timer front panel taken through line 17—17 of FIG. 2.

Turning now to the description of the bussing block 66, this is shown in FIGS. 2, 15A, 15B and 15C. The structure of the top surface 135 is shown in detail in FIG. 15A and is not shown in detail in FIG. 2 since the scale is too small. The four rows 106A through 106D and ten columns 107A through 107J of structure in the housing body 32 are continued in block 66. Only column 107G will be described in detail as the other columns are identical. Block 66 includes third insulating means 136 defining a third channel 137G, fourth insulating means 138 defining four fourth channels, such as 139DG, 139AG, etc., and four slots, such as 142CG and 142AG. Each of the fourth channels, such as 139CG, connect one of the third channels, such as 137G, with one of the slots, such as 142CG. As best shown in FIG. 15B, the slots, such as 142BG, pass through the block 66, while the third channels, such as 137G, and the fourth channels, such as 139BB, are formed in the upper surface 140 of block 66 and pass about ⅔ of the way through the block. Bussing block 66 also has a key groove 144 formed in the lower back side of the block (FIG. 2) forming a lip 145 which abuts rim 122 of housing body 32.

Terminal cover 68 is shown in FIGS. 1B, 2, 16A and 16B. It includes a first portion 147 for enclosing the terminals in the rows 106A and 106D, and an extension 148 extending around the periphery of rows 106B and 106C and having an open end 149. Divider 150 divides extension 148 into two compartments 151A and 151B. Ribs, such as 127, are formed on divider 150 and slots, such as 128, are formed in extension 149. These ribs and slots provide key surfaces which mate with slots and ribs in an external connector (not shown). Each of the compartments 151A and 151B has ten slots, such as 150AE and 150BE, formed in the portion 68. One end of cover portion 68 has a key groove 152 formed in it which fits over rim 122 of housing body 32. The interior dimensions of cover portion 68 are such that bussing block 66 fits flushly within it. Tongues 153A and 153B are formed in the front, lower edge of cover portion 147. Each tongue is tapered along the back side 154 and includes a lip 155 extending toward the front. Tongues 153A and 153B fit into channels 91A and 91B respectively in housing body 32. Two female latch members 156A and 156B are formed on the lower back edge of cover portion 68. Members 156A and 156B have openings 163A and 163B respectively which receive catches 93A and 93B on housing body 32.

Figure 2:
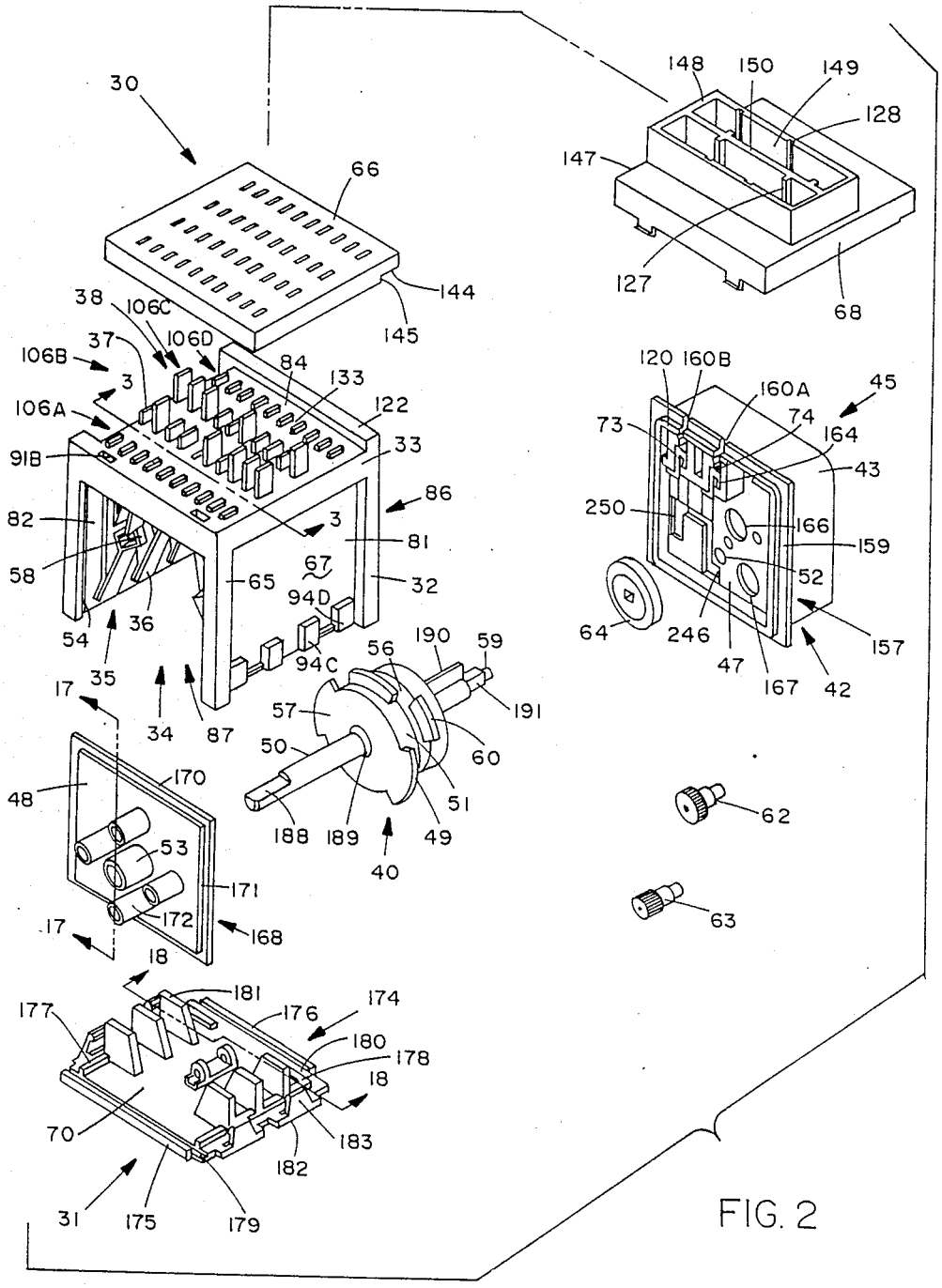
FIG. 2 is an exploded view of the timer of FIG. 1.

The motor housing 43 is shown in FIG. 2 and includes a first panel means 157 for closing the first open side 86 of the housing body 32. Panel means 157 includes motor panel 47 and tongue means 159 which is formed to slide into groove 90. Tongue means 159 has a pair of slots 160A and 160B through which ends, such as 161, (FIG. 7) of motor busses, such as 162, slide to engage motor electrical connectors 73 and 74. Panel means 157 also includes rim 120, the top of which fits into recess 119 (FIG. 9C) of body housing 32 and the outer sides of which abut the inner sides of legs 81 and 82 of housing 32. Panel means 157 also includes two motor connector chambers, such as 164, which are sized to snugly hold the ends, such as 247, (FIG. 8B) of connectors 73 and 74 and the ends, such as 161, of busses, such as 162, with the connectors pressed against the busses to make good electrical contact. The slots, such as 160A, communicate with the chambers, such as 164. Bearings 52, 166 and 167 receive end of camshaft 50, and gears 62 and 63 respectively. The rest of the motor housing is not related to the invention and will not be discussed herein.

Housing 31 also includes second panel means 168. Second panel means 168 comprises front pane. 48 and tongue means 170 which is formed to slide into groove 54 in housing body 32. Second panel 168 is thicker in the area of front panel 48 to form an edge 171 the upper portion of which abuts the lower front edge of closed end 33 and the sides of which abut the inner sides of legs 81 and 82. Front panel also includes camshaft bearing 53 and four mounting studs, such as 172, for receiving screws (not shown) for mounting the timer in an appliance.

Figure 18:
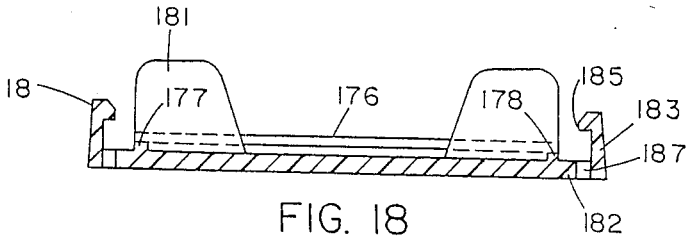
FIG. 18 is a cross-sectional view of the timer base plate taken through line 18—18 of FIG. 2.

Housing 31 also includes cover means 174 for closing the open end 34 of housing body 32 and locking panel means 168 and 157 to the housing body 32. Cover means 174 is shown in FIGS. 2 and 18. Cover means 174 includes base plate 70, flanges 175, 176, 177 and 178. The front edge of plate 70 is grooved at 179 to receive the lower edge of tongue means 170. Another groove 180 is formed by flanges 177 and 178 and flange 176, the flanges spaced to receive the lower edge of tongue means 159. Panel means 174 also includes six ribs, such as 181, which fit between switches 35 to prevent arcing between the contacts of one switch and the contacts of another switch. Four flanges, such as 182, are formed on the sides of plate 70, with a finger, such as 183, on the outer end of each flange, and a lip, such as 185, formed at the end of each finger. The fingers, such as 183, taper upwards. Aperature 187 in flange 182 is to enable the lip 185 to be molded. The flanges, such as 182, and fingers 183 are placed so that the fingers slide between studs, such as 94C and 94D, on housing body 32 and the lips, such as 185, snap over the lips, such as 101 (FIG. 10C) between the studs.

Cam means 40 includes camshaft 50 and cams, such as 56. Camshaft 50 is a generally cylindrical shaft 50 having a flat 188 at one end to attach a knob, a shoulder 189 against which the first cam seats, a key 190 which secures the cams to the shaft, a square cross-section area 191 which secures the clutch to the shaft, and a cylindrical end 59 which turns in bearing 52. There are up to four cams, such as 56 and 57. Only three are shown in FIG. 2 in order to better show the camshaft structure. Each cam comprises a generally cylindrical member and has a number of cam lobes, such as 60. In the preferred timer, each cam, such as 57, has two cam tracks, such as 49 and 51. Timer 30 also includes two-way clutch 64 and gears 62 and 63 which turn in bearings 166 and 167 respectively. The details of the clutch and gears do not play a role in the invention, and therefore will not be discussed.

Figure 3:
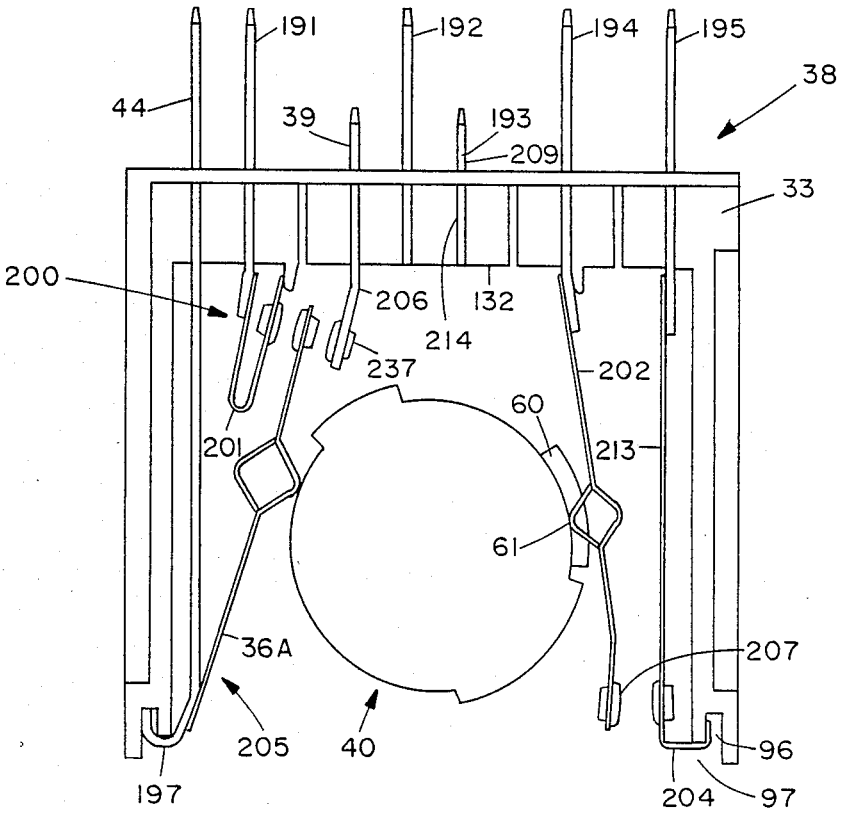
FIG. 3 is a front view of an exemplary timer partially assembled and showing the relationship of exemplary parts.
Figure 4A:
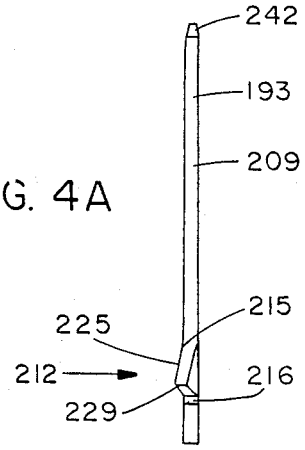
FIGS. 4A and 4B are edge and broad-side views respectively of a dummy terminal.
Figure 4B:
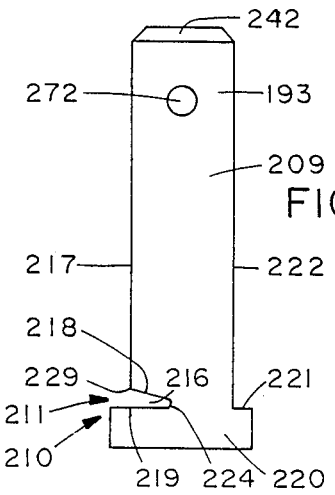

The structure of the terminals and switch blades is shown in FIGS. 3 through 8A. It should be understood that FIG. 3 is not the same embodiment as the embodiment of FIGS. 1 and 2, but rather represents a housing body 32 with a variety of terminals and switch blades attached to represent the variety of different blades and terminals that may be used in the preferred timer. A terminal, such as 44, may extend all the way from external of the top of the housing body 32 to the lower end of the body 32, or to just inside the lower surface of closed end 33, such as in terminals 191, 194, and 195, or may be a dummy terminal 193 which terminates at the lower surface 132 of closed end 33. They may be straight, as terminal 195, bent, such as 191 and 194, or formed with a hook 197 on an end, as terminal 44. The terminals 38 protruding through the end 33 of housing body 32 may have long ends, such as in the case of terminal 44, or short ends, such as in the case of terminal 39. There are also many varieties of switch blades 200. They may be u-shaped, as blade 201, elongated and straight as blades 36A and 213, elongated and bent, as blade 202, or have a hook 204 on the end, as blade 213. The terminal-blade combinations may be two-piece, such as terminal-blade combination 205, or may be one-piece, as terminal-blade combination 206. All of the blades 200 have contacts, such as 207, attached near their distal ends, and the blades that are driven by the cam means 40 have v-shaped cam followers, such as 61, generally integrally formed with the blade. The contact and cam follower structure, and the attachment of the blades and terminals and the contacts to the blades are conventional and will not be discussed herein. The structure of the terminals 38 which attaches the terminals to the closed end 33 is unique and is shown in FIGS. 4A and 4B, which depict a dummy terminal. The terminal 193 includes stop means 210 for engaging housing 31 to prevent motion of the terminal blade 209 in one direction through a slot in the housing, such as 214. (FIG. 3). In the preferred embodiment, this one direction is the direction upward in the plane of the drawing of FIG. 3. The terminal 193 also comprises first ramp means 211 for engaging the housing along a scissoring intersection to prevent motion of the terminal blade 209 in the opposite direction; i.e. the downward direction in the plane of the drawing in FIG. 3. The terminal 193 also includes second ramp means 212 for urging the first ramp means 211 into the slot, such as 214, as the blade 209 is inserted into the slot. In the preferred embodiment, the insertion is from the bottom side 132 of closed end 33 toward the top. In the preferred embodiment, the blade 209 has a notch 216 formed in one edge 217. The stop means 210 comprises one side 217 of the notch and the first ramp means comprises the other side 218 of the notch. The terminal has a flange 220 formed at one end; side 217 forms one edge of the flange and lip 221 forms the other. Both side 219 and lip 221 are perpendicular to the sides 217 and 222 and to the direction slot 214 passes through end 33, referred to herein as the "first" direction. Both side 219 and lip 221 extend a short distance beyond their respective sides 217 and 222 of terminal 193. Side 218 of notch 216 is formed preferably at an acute angle with perpendicular to side 217 and the first direction. Notch 216 is preferably rounded at its proximal end 224. As best seen in FIG. 4A, the upper side 218 of notch 216 is also bent out of the plane of the terminal blade 209 so that side 218 of the notch 216 is not in the same plane as side 219 of the notch. This bent portion 225 of the terminal blade 209 forms the second ramp means 212. How the blade 209 shown in FIGS. 4A and 4B interacts with the end 33 of housing body 32 to firmly fix the blade 209 to the housing 31 can best be seen by examining FIGS. 4A and 4B and FIGS. 9F and 9G. In FIG. 9F, the first direction, i.e. the direction in which the slot 108AJ passes through end 33, is the horizontal direction, while in FIG. 9G, it is the vertical direction. The blade 209 would be inserted from right to left in FIG. 9F and from bottom to top in FIG. 9G. When the blade is inserted, bent portion 225 of blade 209 engages the side 227 of slot 108AJ and urges the side 218 of the notch into the slot 108AJ. The blade 209 may then be further inserted until the tip 229 of the bent portion 225 passes the lower edge 230 of cavity 129AJ, at which point it begins to snap back out of the plane of slot 108AJ into the cavity 129AJ. Cavity 129AJ and slot 108AJ meet at edge 231. As blade 209 is pushed further into slot 108AJ, bent portion 225 will continue to move further into cavity 129AJ with the edge 218 engaging edge 231 along a scissoring intersection. The blade 209 will stop when side 219 of notch 216 and lip 221 of flange 220 engage the inner walls 233 and 234 of end 33 respectively. The dimensions are such that this will occur before bent portion 225 has fully entered cavity 129AJ. Thus the scissoring effect of the bent portion 225 with the edge 231 of the cavity 129AJ will hold the blade firmly in place over a range of positions of the blade 209 in slot 108AJ determined by the tolerance variations of the dimensions of the blade 209 and closed end 33 in the first direction; i.e. it will absorb tolerance variations in the first direction. When the blade 209 is inserted in slot 108AJ, crush bump 130AJ will be partially crushed to absorb tolerance variations in the direction perpendicular to the first direction. FIGS. 5A and 5B show two views of a portion of one-piece combination terminal-switch blade 39. This terminal has a blade extension 235 which is bent to the left in FIG. 5A and an opening 236 for insertion of the contact 237. FIG. 6 shows a portion of terminal 195 which includes two semi-perf embossments 238 and 239 which are inserted in holes in the blade, such as 213, and are staked on the opposite side of the blade 213 to conventionally attach the terminal to switch blade 213. The attachments of the other blades to the terminals is made similarly. The form of terminal 195 is similar to the form for terminal 191 except the latter is bent to the left. FIG. 7 shows the form for motor terminal 240 which is integrally formed with bus portion 162 and an end portion 161 which, as discussed above, connect to the motor electrical connectors 73 and 74. All of the terminals 38 have a wedge-shaped end as shown at 242 in FIGS. 4A and 4B. The lower tip 243 of end portion 161 is wedge-shaped also. All of the terminals described above may be formed in either left-handed or right-handed versions, the left-handed versions being used on the left side of housing body 32 and right-handed versions being used on the right side of housing body 32.

A motor electrical connector 73 is shown if FIGS. 8A and 8B. The connector 73 includes a portion 247 and a portion 248 in generally perpendicular planes. Portion 247 is folded over to make a spring top 249 and the sides 251 and 252 of portion 248 are folded up to provide a bias force to hold the connector 73 in a recess 250 in panel 47, and also to provide extra electricity carrying surfaces in a critical connecting area. It is also lanced and bent to form connector socket 253. The other motor electrical connector which fits in recess 246 is similar except the part corresponding to neck 245 is longer.

Figure 14:
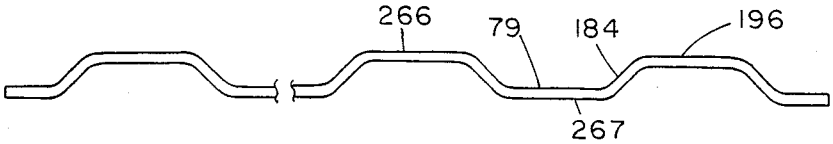
FIG. 14 is a narrow-side view of corrugated (third) bus to be used with the maze of FIGS. 15A and 15C.

The electrical busses used in conjunction with the insulating maze means 71 in closed end 33 and the insulating maze means 72 in bus block 66 are shown in FIGS. 11 through 14. First bus 76 is a thin, flat, piece of conductor shaped into a corrugated form of a size to fit snugly into the first channel, such as 124A (FIG. 9A). The bus is shown in the plane of its thinner edge in FIG. 11. FIGS. 12A and 12B show a terminal connecting bus 77. This bus is hook-shaped with a u-shaped portion 254 at approximately right angles to a straight portion 255. The preferred embodiment of the second bus 78 is shown in FIGS. 13A and 13B. It is preferably c-shaped with two pair of opposing flat surfaces; i.e. pair 257 and 258 and pair 259 and 260. The preferred third bus is shown in FIG. 14. This bus is shaped to fit snugly in the third channels, such as 137G. The width of the first, second and third busses 76, 78 and 79 respectively are preferably equal, so that FIG. 13B may be used to approximately gauge the width of all three busses. Generally this width is such that the busses are flush with or below the surfaces 133 and 140 when they are fully inserted into their respective channels. One side 265 of busses 76, 78 and 79 is wedge-shaped to ease entry into their respective channels. In the preferred embodiment, the undulations of first bus 76 and third bus 79 are flattened so that the busses take a corrugated form. The opposing flat surfaces, such as 262 and 263, of first bus 76 are spaced apart in the vertical direction in FIG. 11 such that when they are placed in the first channels and second busses 78 are placed in corresponding second channels, the undulations are compressed between surface 259 of the second bus and the far wall, such as 264C, of the first channel (FIG. 9A). Further the opposing surfaces, such as 266 and 267 of third bus 79 are spaced vertically in FIG. 14 such that when the third busses 79 are placed in the third channels, such as 137C, and the second busses 78 are placed in corresponding fourth channels, such as 139DC, the undulations are compressed between the surfaces 257 of second busses 78 and the far wall 268C of the third channel. Exemplary first, second and third busses 76, 78 and 79 respectively are shown in place in their respective channels in FIGS. 9A and 15A. For clarity, not all busses that would be in place in the exemplary preferred embodiment of the timer are shown in these FIGS. The second bus 78 is shaped so that it may be used to connect first busses 76 with terminals 38 and also used to connect third bus 79 with terminals 38. As shown in FIG. 9A, the second busses are held in the second channels by surfaces 257 and 258 being compressed between the terminal, such as 38CI, and the opposite wall, such as 270CI, of the second channel, and also by the compression of bus 78 and bus 76 between the wall, such as 271CB, of the second channel and the wall, such as 264C, of the first channel. The bus 78 thus acts as a bias means 78 to hold the first and second busses 76 and 78 in their respective channels. Further the first bus 76 also provides acts as an additional bias means 76 for holding the first and second busses in their respective channels. The second bus 78 also provides a second bias force for contacting the terminals, such as 38CI. With respect to the bussing block 66 (FIG. 15A) second bus 78 similarly provides the bias force for holding the second and third busses in their respective channels and to contact the terminals, except in this case the bus 78 contacts the side 222 of the terminal. The terminal connecting bus 77 is shaped so that the u-shaped portion 254 fits into the cavities, such as 129AJ and the edges 271 and 272 are compressed between the opposing terminals. A terminal connecting bus 77 is shown inserted into cavity 129DB in FIG. 9A.

A principal purpose of the maze means 71 and the maze means 72 (FIGS. 9A and 15A) is to lengthen the air paths between the busses 76 and terminals 38 and the busses 77 and the terminals 38. This function is performed in two principal ways. First, the second channels 126 are each curved to create an air path between the busses 76 and terminals 38 that are not connected that is much longer than the straight line distance between them. In the preferred embodiment, the air path is more than three times the straight line distance. Likewise, the fourth channels are curved to the same effect. At the minimum, the bend of the second channels should be of sufficient arc that the busses 76 and any one of the terminals 38 cannot be connected by a straight line in any plane passing through its corresponding second channel without also passing through the second insulating means 125. Likewise for the third channels and their respective terminals. The second way the air path between the busses 76 and 79 is lengthened is by the undulating form of the busses 76 and channels 124 in which they are received. The undulations are such that the vertical distance between the busses 76 and the terminals becomes larger as the horizontal distance becomes less, and vice-versa. Likewise for the busses 79 and third channels 137. Put in another more technical way, if a straight line is drawn through any row of terminals in FIG. 9A, such as the line 9B—9B through row 106B, then the undulations are such that the portions of the channels between terminals (in the horizontal direction in FIG. 9A) are closer to the straight line than the portions adjacent the terminals, i.e. in the same vertical plane as the terminals. The same holds true for the third channels 137 in FIG. 15A with the terms horizontal and vertical exchanged.

Figure 19:
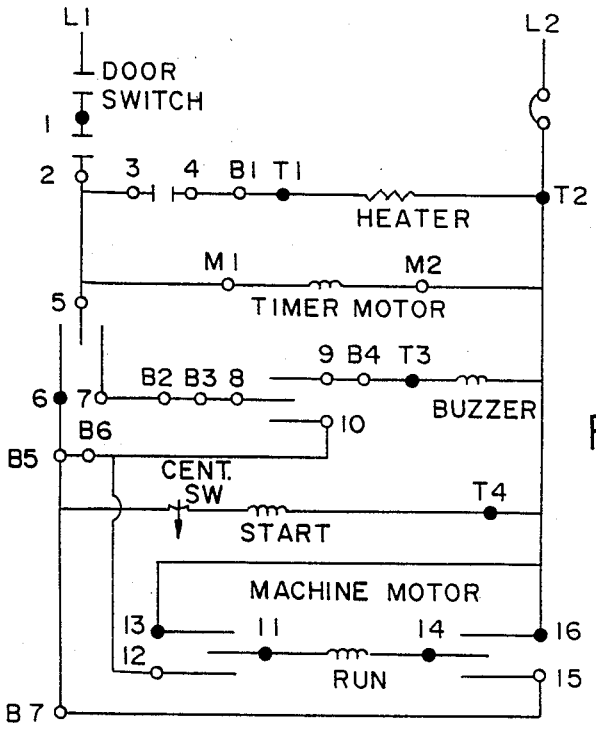
FIG. 19 is an electrical circuit diagram of the timer of FIG. 1.
Figure 20:
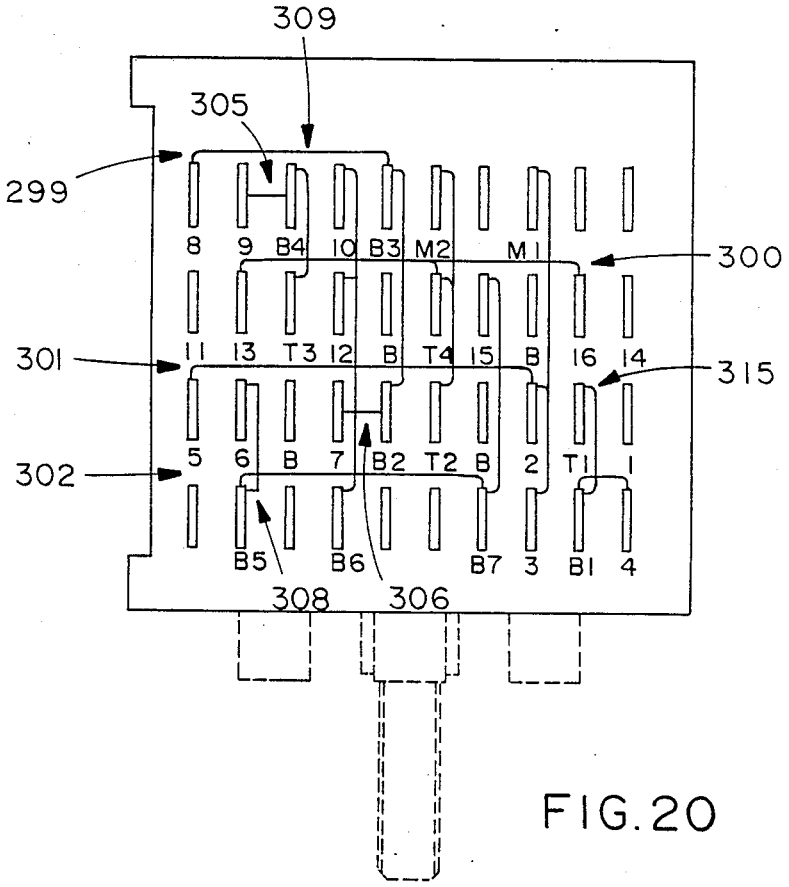
FIG. 20 is an electrical diagram showing the electrical bussing connections between the terminals of the timer of FIG. 1 to produce the circuit of FIG. 19.
Figure 21:
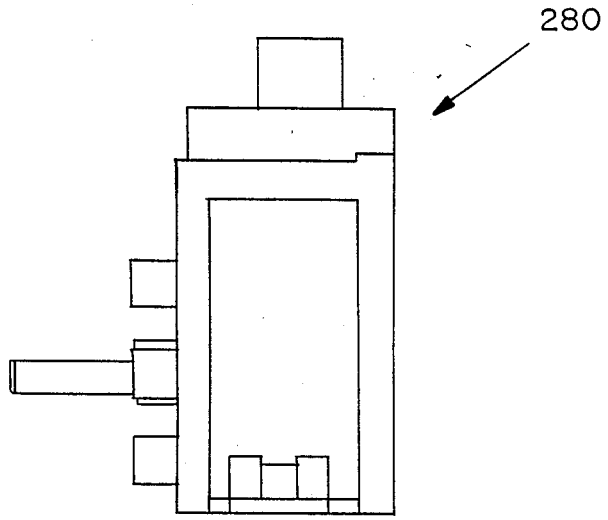
FIG. 21 is a side view of an alternative preferred embodiment of a timer according to the invention.
Figure 22:
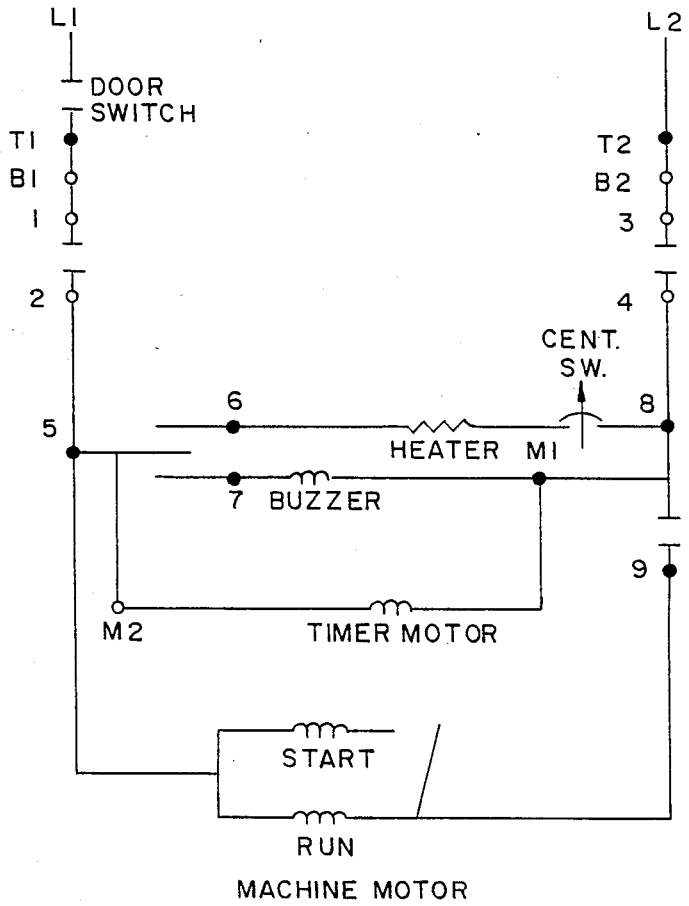
FIG. 22 is the electrical circuit diagram of the timer of FIG. 21.
Figure 23:
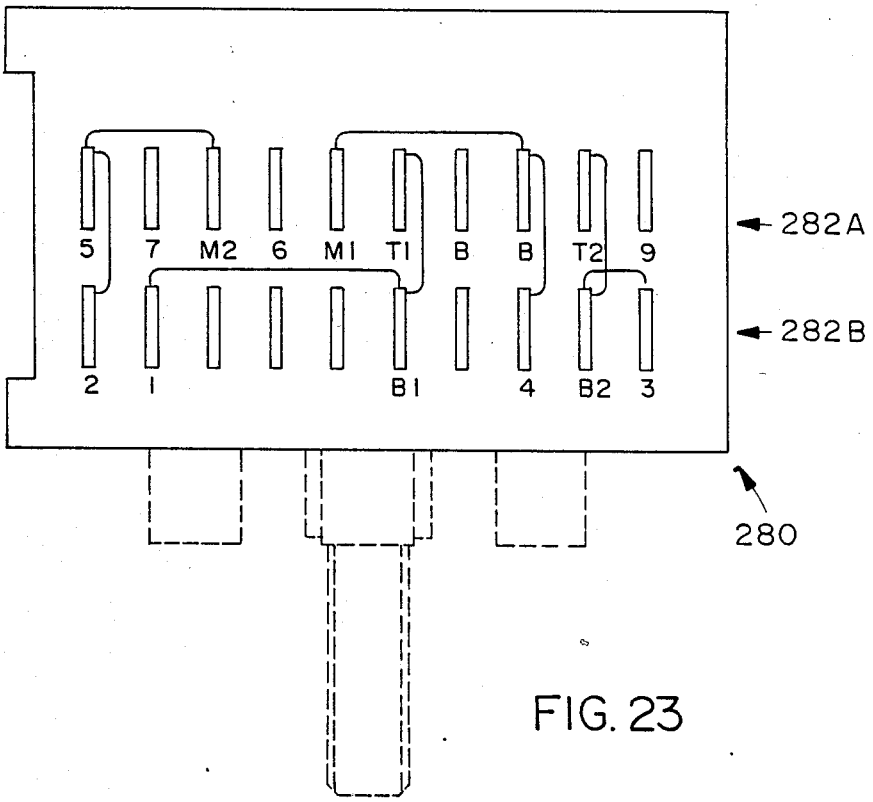
FIG. 23 is an electrical diagram showing the bussing connections between the terminals of the timer of FIG. 21 to produce the electrical circuit of FIG. 22.
Figure 24:
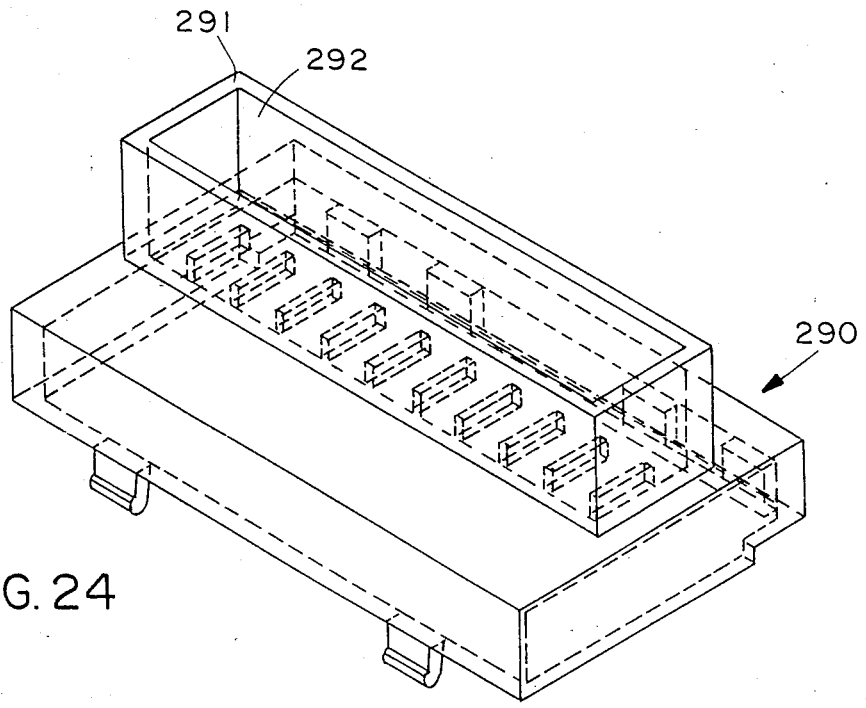
FIG. 24 is a perspective view of the terminal cover of the timer of FIG. 21.

As indicated above, the terminals can have long ends, such as terminal 44 or short ends, such as terminal 39. The long terminals connect with an electrical connector, and the short terminals are covered with cover 68. In the preferred embodiment, the bussing by busses 76, 77, 78 and 79 is such that all the long terminals are in two rows. This facilitates their being connected to an external connector. A typical dryer timer circuit is shown in FIG. 19. In this FIG., L1 and L2 are the line voltages and the numerals 1 through 16, B1 through B7, T1 through T4, and M1 and M2 represent terminals. In FIG. 20, a bussing scheme is shown schematically which would result in all the long terminals being in the middle two rows, as in the preferred embodiment 30 of the invention. Another embodiment 280 is shown in FIG. 21. In this embodiment, there are only two rows 282A and 282B (FIG. 23) of terminals. A typical dryer circuit for this embodiment is shown in FIG. 22 and the bussing scheme which would result in all long terminals being in row 282A is shown in FIG. 23. In this embodiment, the terminal cover 290 (FIG. 24) includes an extension 291 having a single chamber 292. The other elements, such as switch blades, cams, terminals, etc. are similar to the embodiment 30.

The terminal securing structure which permits the terminals 38 to be firmly anchored to the housing in a closed end 33 with relatively small thickness, the maze structure which allows the terminals 38 to be relatively close together without arcing, and the organization of the timer parts permit the timer to be very compact. For example, the terminals are anchored in only 0.30 inches of plastic as compared to the 0.60 inches of timers in the prior art. While the particular size of the parts may be varied and will depend to some extent on the particular application of the timer, exemplary sizes of parts of the preferred embodiment are as follows. The housing body 32 is 2.290 inches wide, by 2.230 inches high (at the rear edge), by 2.220 inches in depth (from front to back). The four vertical columns, such as 65, which form the outer edges of the housing body 32 are each 0.170 inches wide by 0.210 inches deep. Grooves 54 and 90 are 0.070 inches wide by 0.080 inches deep, and ribs 104B and 103B extend 0.580 inches below surface 132, the gap between them is 0.20 inches, and they slope upward at their inner edge at 40°. They are 0.056 inches thick. The wall 67 of legs 81 and 82 is 0.80 inches thick. Stud 94A is 0.265 inches high by 0.190 inches wide, and 1.70 inches across the thickest part of FIG. 10D, slot 97 is 0.085 inches high by 0.120 inches wide (the horizontal direction in FIG. 10B) by 0.110 inches deep (the horizontal direction in FIG. 10D), while recess 96 penetrates another 0.10 inches into stud 94A vertically in FIG. 10D and is 0.060 inches wide in the plane of FIG. 10D. The point 102 of ramp 100 is 0.128 inches high and sticks out 0.060 inches from the side of leg 81 and the lip 101 slopes at 102°. The front edge of the recess 96 in stud 94A is 0.265 inches from the front of the housing body, and the studs 94A through 94D are spaced 0.43 inches apart. On the other side (leg 82) the front edge of the first recess 96 is 0.365 inches from the front of the housing body and the studs are 0.43 inches apart also. Flanges 111A and 112B are 0.100 inches long and 0.048 inches wide. The closed end 33 is 0.300 inches thick. The slots, such as 108AJ, are 0.254 inches wide and 0.036 inches thick. They are separated by 0.197 inches center-to-center in the horizontal direction in FIG. 9A and 0.43 inches in the vertical direction. The crush bumps, such as 130AJ, extend 0.200 inches into the slots, and are 0.10 inches wide at the tip, and the upper surface 134 is located 0.159 inches from the top 133 of the housing body 32. The lower surface 131 slopes at 20°. The cavities, such as 129AJ, are 0.159 inches deep, 0.091 inches wide in the horizontal direction in FIG. 9A, and 0.115 inches in the vertical direction. The grooves, such as 109A and 110A, at the side of the slots are each 0.050 inches wide by 0.100 inches deep. The first and second channels, such as 124A and 126AI, are 0.159 inches deep. Referring to FIG. 9E, the dimensions of the channels 124A and 126AI are perhaps best described by defining the shape and size of the spade-shaped portion 46 of insulating means 125. The roughly rectangular head 41 of the "spade" 46 is 0.063 inches square. Channel 126AJ is 0.028 inches wide at the bottom and right side of head 41 and 0.026 inches wide on the left. The narrowest portions of channel 124A are 0.028 inches wide. The side 67 of "spade" 46 is at 45° to the vertical and blends into head 41 in a 0.025 inch radius at a point 0.050 inches from the right side of slot 108AI and on the left end blends into a 0.040 inch radius curve 69 which blends into the next channel. The ends of channel 124A are rounded in 0.014 inch radii. The corners of head 41 are rounded in a 0.015 inch radius. All other corners not specified above are rounded in a 0.010 inch radius. The wall 271AI of channel 126AI is located 0.185 inches from the bottom end of slot 108AI and wall 264A of channel 124A is located 0.376 inches from the bottom end of slot 108AI. Buss block 66 is 1.941 inches in the vertical direction in FIG. 15A, 2.110 inches in the horizontal direction and 0.229 inches thick. The key groove 144 (FIG. 2) is 0.130 inches long by 0.054 inches wide. The slots, such as 142AG, are sized and spaced as described above for the closed end 33 of housing body 32 and pass all the way through the block. Channels 137 and 139 are 0.159 inches deep. Taking the bottom and left edges 273 and 274 of slot 142CG as the horizontal and vertical reference lines respectively in FIG. 15C, the top and bottom sides of spade head 80 are spaced 0.034 inches and 0.016 inches respectively from the horizontal reference line 273. Side 83 meets the left side of head 80 at a point 0.014 inches above the reference line 273 and side 85 runs from a point 0.16 inches below the reference line 273 to a point 0.02 inches below the reference line 273. Both sides 83 and 85 are sloped at 45° to the horizontal. The walls 88 and 89 of the third channel 137F above the slot 142CG are spaced 114 inches and 0.079 inches respectively from the horizontal reference line 273, while the wall 95 of channel 137G is spaced 0.043 inches below the reference line 273. Wall 98 of channel 139CG is located 0.069 inches above the reference line 273. Sides 198 and 199 of third channel 137G are sloped at 45° to the horizontal. Side 198 extends from a point spaced 0.204 from vertical reference line 274 to a point 0.239 inches from the line 274, while side 199 lies between points 0.384 inches and 0.419 inches respectively from the reference line 274. Walls 114 and 115 of channel 139CG are spaced 0.239 inches and 0.371 inches respectively from reference line 274, and the left and right vertical side walls of head 80 are spaced 0.286 inches and 0.336 inches respectively from line 274. The wall 98 of channel 139CG meets walls 114 and 115 in 0.025 inch radii curves, and the corners of head 80 and both ends of sides 83 and 85 are rounded in 0.005 inch radii. The corners of slot 142CG are sharp.

Turning now to FIGS. 11 through 14, busses 76, 78 and 79 are all made of 0.016 inch OLIN TM thick 197 copper alloy and are 0.150 inches wide. First bus 76 is spring temper alloy 1.970 inches long or can be made in shorter lengths to connect terminals 38 that are closer together. The undulations have a wave length of 0.197 inches and an amplitude of 0.032 inches from the center line. The flat areas, such as 262 and 263, are 0.0212 inches long and the sides between them are angled at 49.9 degrees to the horizontal. The junctures of the flat areas with the angled sides are rounded in 0.040 inch radii. Second bus 78 is full hard alloy 0.120 inches wide in both the horizontal and vertical directions in FIG. 13A. The gap 75 is 0.062 inches measured across the closest points. Measured in the vertical direction from side 257 to end 173, the gap is 0.060 inches and the same length in the horizontal direction. The corners are rounded in 0.024 inch radii, and the sides of the wedges are coined in a 0.070 inch radius on both sides. The horizontal distance between the outside edges of the wedges, such as 265, across the width of the bus is 0.110 inches. Third bus 79 is spring temper alloy 1.720 inches long or shorter. The undulations 196 have a wave length of 0.430 inches and an amplitude of 0.034 inches from the center line. The flats, such as 266 and 267, are 0.137 inches wide and the connecting portions 194 are angled at 45°. The flats, such as 267, and the connecting portions 184 are joined in 0.040 inch radii. Terminal connecting bus 77 is 0.020 inches thick OLIN TM 197 copper alloy, spring hard and is 0.103 inches wide. It is 0.147 inches high in the vertical direction in FIG. 12B and 0.181 inches wide in the horizontal direction. Straight portion 255 is 0.083 inches long, the hook 254 is curved at the bottom about a 0.020 inch radius and angled at the end at 11.25 degrees to the vertical. The tip 269 of side 271 is located 0.021 inches vertically from the upper edge of straight portion 255.

Turning now to FIGS. 4A through 7, the terminals 38 are made of 0.032 inch thick CDA alloy 260 brass, three-fourths hard. The blade 209 of dummy terminal 193 is 0.250 inches wide. Slot 216 is 0.150 inches deep along side 219 and 0.041 inches wide at tip 229. Side 218 is angled at 10.2 degrees. Flange 220 is 0.350 inches wide in the horizontal direction in FIG. 4B and 0.100 inches high, with lip 221 extending out 0.050 inches from side 222. The bent portion 225 of the blade 209 is bent so that the width from the left end of tip 229 in FIG. 4A to the far right side of the terminal is 0.056 inches. From the beginning of bend 225 at about point 215 to the side 219 is 0.202 inches vertically. The wedge end 242 is 0.035 inches long with sides angled at 45° in FIG. 4B and 10° in FIG. 4A. Opening 272 is centered horizontally and 178 inches from the top end of blade 209. The structure of the notches and stops of the terminals of FIGS. 5A through 7 are similar. Motor bus portion 162 of terminal 240 (FIG. 7) is 0.347 inches long and end 161 is 0.260 inches high and 0.200 inches wide, the dimensions including the portions of the two parts 161 and 162 which overlap. Motor electrical connector 73 (FIGS. 8A and 8B) is made of 0.016 inch brass CDA 260 57000-67000 psi tensile strength. Portion 247 is 0.125 inches wide in the vertical in FIG. 8A and 0.105 inches in the vertical in FIG. 8B. The spring tip 249 is 0.100 inches horizontally in FIG. 8B from the left end of portion 247. Neck 245 is 0.120 inches wide and 0.360 inches long and portion 248 is 0.260 inches wide and 0.647 inches long. Other dimensions of the various parts of the timers 30 and 280 will be evident from the description above.

The housing body 32, panel means 157 and 168, cover means 174, and bus block 66 may be made of ridged PVC, such as Geon TM 87241 or Georgia Gulf TM 7107, or other suitable insulating material. Terminal cover 68 is preferably made of nylon FR VO or other suitable insulating material. The other portions of the timers 30 and 280 not already specified above are made of conventional materials.

The timer 30 is assembled as follows. The contacts, such as 207, (FIG. 3) and terminals, such as 194, are conventionally attached to the switch blades, such as 202, and then the terminals 38 are inserted into the appropriate ones of slots 108 in the closed end 33 of housing body 32. The motor means 42 is assembled in motor housing 43 with motor electrical connectors 73 and 74 in recesses 250 and 246 respectively, and gears 62 and 63 in bearings 166 and 167 respectively. Up to four double cams 56 and 57 etc. are placed on cam shaft 50, clutch 64 is placed on shaft portion 191, end 59 is placed in bearing 52 and end 188 is inserted through bearing 53, and the tongues 159 and 170 of panel means 157 and 168 respectively are slid into grooves 90 and 54 respectively, with cam means 40 passing through open end 34 of housing body 32 from the bottom toward the top until the cam tracks, such as 49 and 51, engage the cam followers, such as 61, on the switch blades, such as 202. At the same time, the ends 161 of motor connecting busses 162 slip into the slots 160A and 160B and into the motor connector chambers, such as 164, to contact the tips, such as 249, of motor electrical connectors 73 and 74. Cover means 174 is then snapped onto the housing body 32 with fingers, such as 183, sliding between studs, such as 94C and 94D, and lips, such as 185, riding up ramps, such as 100, and snapping over lips, such as 101. First busses 76 and second busses 78 are then placed in first channels 124 and second channels 126 respectively as required in order to provide the horizontal connections shown at 299, 300, 301 and 302 in FIG. 20. Terminal connecting busses 77 are then inserted in cavities 129DB and 129BD to provide the connections 305 and 306 in FIG. 20. Third busses 79 and second busses 78 are then placed in channels 137 and 139 respectively as required to provide the vertical connections 308 through 315 in FIG. 20, and buss block 66 is assembled on housing body 32 with terminals 38 passing through slots 142 as appropriate so that buss block 66 may be pressed down until surface 141 meets surface 133 and key 144 keys on rim 122. In the preferred embodiment, a sealant/adhesive, such as Stycast TM 22760 Potting Compound, may be applied between the surfaces 141 and 133 before they are pressed together. Terminal cover 68 is then assembled on top of the bus block 66 with the terminals 38 in the middle two rows 106B and 106C passing through slots, such as 150AE and 150BE in cover 68, until tongues 153A and 153B slide into channels 91A and 91B respectively, and latch members 156A and 156B engage catches 93A and 93B respectively. The cover is then snapped in place with lips, such as 155, of the tongues, such as 153B, snapping over lips 92A and 92B in channels 91A and 91B respectively and catches 93A and 93B snapping into openings 163A and 163B respectively of female latch members 156A and 156B respectively. Again, in the preferred embodiment, the sealant/adhesive, such as Stycast TM 22760 Potting Compound may be applied between bus block 66 and cover 68 to seal the mating surfaces between them. The timer has now been completely assembled with no separate fasteners, welds, soldering, etc.

It is a feature of the invention that the timer is easily adapted to automatic assembly. All units are snapped together along a vertical direction. No special jigs are required. In particular, the cam slips into the housing body 32 in a direction along a radius of the cam shaft and thus engages the switch blades 35 with no hang-ups. The housing parts are all connected by tongue and groove and snap-in type connections.

Another feature of the invention is that all the terminals 38 are located in one integral housing member, i.e. housing body 32, and further that all are located in one planar member, closed end 33. This prevents tolerances from stacking, which would lead to misalignment of terminals and/or switch blades. The feature also maintains a high degree of rigidity between the terminals. In addition the tongue and groove interconnection of housing body 32, panel means 157 and 158 and cover means 174 further provides for the structural rigidity of the timer as a whole. Thus this feature enhances timing repeatability and structural integrity of the timer.

Another feature of the invention is that the electrical conductors of the timer are completely enclosed except for the terminals exposed in compartments 149 and 150, which terminals are easily covered by a female-type electrical connector socket (not shown).

A further feature of the invention is that the bussing is such that while there are n rows of terminals, connections need be made to only m rows of terminals, where m is less than n (and at least one). In the timer 30, for example, $n=4$ and $m=2$. In the timer 280, $n=2$ and $m=1$. The terminals are also arranged so that the terminals to which connection is to be made are all longer than the terminals to which connection is not to be made, and all the longer terminals extend from the housing body 32 in a predetermined direction. A related feature is that cover 68 entirely covers the rows to which connections are not made. Connector polarization is accomplished by a series of ribs 127 and slots 128 on the walls of cavities 149 and 150 which mate with an external connector. (The external connector is not shown on the drawings.)

Another feature of the timer is the organized presentation of the terminals in close array. The maze means 71 and 72 is a primary reason for this feature. The maze means 71 and 72 allow interconnections to be made between the terminals 38 to organize the terminals in rows of long and short terminals as indicated above, while still providing relatively long air paths between the conductors. All vacant space between conductors where connections are omitted are shaped in such a way as to provide at least 3 mm in developed length between any two separately exposed conductors; i.e. busses 76 and terminals 38 and/or busses 79 and terminals 38. The standing insulator of the maze means 71 and 72 has a much higher breakdown voltage than air and thus prevents arcing or leakage between exposed conductors. The ribs, such as 103A, 103B and 103C and 181 also have relatively high breakdown voltage and provide insulating material between the contacts and connections of terminals and blades where arcing and leakage could otherwise be a problem because of the shapes of surfaces and the inertia of current. It is a related feature that the maze means 71 and 72 also result in the ability to provide the close array of terminals in a dryer timer which innately carries higher current loads than a washer timer, and permits such a dryer timer to be very compact.

An optional feature of the invention is that the mating surfaces between bus block 66 and housing body 32 and bus block 66 and cover 68 are sealed with adhesive sealant. This completely encapsulates the busses 76, 77, 78 and 79 which prevents any air paths at all between them and the terminals which adds further protection against arcing and leakage.

Another feature of the invention is that the busses 76, 77, 78 and 79 each provide a bias force for holding the busses in place and for making electrical contact between the busses and the terminals and the busses with each other. Each of the busses also provide relatively broad flat surfaces, such as 262 and 263 on bus 76, 254 on bus 77, 257 and 259 on bus 78, and 266 and 267 on bus 79, with which to make the electrical connections and which also serve to stabilize the bias forces.

Another feature of the invention is that the same electrical bus, i.e. the second bus 78, is used to make the connections between the common bus and the terminals for both the x and y common busses (first and third busses) despite the fact that the terminals are not symetric in the x and y directions.

A further feature of the invention is that the terminal connecting bus 77 provides a second route for connecting terminals in the x direction, so long as the terminals to be connected are adjacent. That is, the first bus 76 provides one route while the terminal bus 77 provides another route for connecting terminals in the horizontal direction in FIG. 9A. This allows double utilization of the x bus direction. This feature is particularly useful when bus routes of two different polarities are necessary. For example, referring to FIG. 20, the route 309 is provided by the first bus 76 and is of one polarity while the bus route 305 is provided by a terminal connecting bus 77 and is of a different polarity. The requirement that adjacent terminals be of the same polarity happens relatively often in actual applications, thus this feature is very useful.

An important feature of the invention is the way the terminals 38 are secured to the housing body 32 with a double ramp. This feature allows the terminals to be firmly attached to the housing, which is a must for timing repeatability and long term reliability, with the attachment being made by simply sliding the terminals 38 into the housing body 32 requiring no additional parts. This eliminates significant manufacturing steps in prior art timers and makes the timer economical, both with respect to the cost of parts and the cost of assembling them. The first ramp means 211 provides a scissoring intersection. That is, the point of contact between the housing and the ramp moves like the point of contact between scissors blade and an object it is cutting. The point of contact moves until movement is stopped by the side 219 of the notch 216, and then, the blade cannot back out since the scissoring intersection has moved with the entry of the blade. The second ramp means 212 provides the required deformation of the blade portion 225 to allow it to pass through the slot during the terminal insertion operation. The second ramp means facilitates assembly without excessive flexing of the molded housing body 32. This assembly method and apparatus makes precision location of terminals possible, allows the terminals to be placed closer together since fasteners, such as rivets etc. which could lead to arcing are not present and also simply because of the lack of bulk of the parts that are in other timers, eliminates the extra part, i.e. the cover, of prior art timers such as that disclosed in U.S. Pat. No. 4,734,548, it alleviates problems of tolerance variation because of absorption of tolerance variations by the first ramp means, and permits the anchoring of the terminals to be made in about ½ of the thickness of plastic insulator as compared to prior art timers, which further reduces timer size.

A novel electromechanical timer that is easy to make electrical connection to, is both compact and reliable, and is particularly adaptable to automated manufacture has been described. It is evident that those skilled in the art may now make numerous uses, modifications of, and departures from the specific embodiments described without departing from the inventive concepts. For example, the various housing parts may take on many shapes and sizes, provided the terminals are still arranged in rows with all the long terminals in just a few or one of the rows. Otherwise the terminals and blades can take on many different shapes and sizes. Many other variations may be made. Consequently, the invention is to be construed as embracing each and every novel feature and novel combination of features present in and/or possessed by the electromechanical timers described.

What is claimed is:

1. An appliance timer comprising:

a motor-driven cam;

electrical switches responsive to said cam, each of said switches comprising a pair of contacts;

a plurality of electrical terminals for selective connection to circuits in the appliance, at least one of which is electrically connected to at least one of said switches;

housing means for supporting said cam, said switches, and said terminals;

said terminals defining n rows of terminals where n is 2 or more, each row having at least one terminal in it, and m of said rows of terminals containing a plurality of longer terminals which extend further from said housing in a predetermined direction than terminals in the other rows of said terminals, m being less than n and at least one; and cover means for covering said other rows of terminals while leaving said longer terminals in said m rows exposed.

2. An appliance timer as in claim 1 wherein said cover means comprises a first portion enclosing said other terminals and an extension extending around the periphery of said m rows and having an open end.

3. An appliance timer as in claim 2 and further including key means on said cover for permitting a connector to be connected to said extension in only one orientation.

4. An appliance timer as in claim 1 and further including bussing means for connecting selected ones of said terminals, said selected terminals being chosen according to the function to be performed and wherein said cover means comprises means for covering said bussing means.

5. An appliance timer as in claim 4 wherein said housing includes insulating maze means for providing that all air paths between said bussing means and said terminals that are not electrically connected to said bussing means are at least 3 mm in length.

6. An appliance timer as in claim 1 where n is equal to 3 or more and m equals 1 or 2.

7. An appliance timer as in claim 1 where n equals 2 and m equals 1.

8. An appliance timer as in claim 1 and further including a cover, and snap connection means for permitting said cover to be snapped on to said housing.

9. A method of assembling an appliance timer comprising the steps of:

providing a timer comprising a motor-driven car, electrical switches responsive to said cam, a plurality of electrical terminals at least one of which is electrically connected to at least one of said switches, and housing means for supporting said cam, said switches, and said terminals, said terminals extending from said housing and defining n rows of terminals with m rows containing a plurality of longer terminals which extend further from the housing in a predetermined direction than terminals in the other rows of said terminals, m being less than n and at least one; and covering said terminals in said other rows while leaving said longer terminals in said m rows exposed for connecting to an external connector.

10. A method as in claim 9 which before said step of covering further includes the steps of:

providing a maze of standing insulative channels in said housing such that all air paths between terminals and conductors connecting said terminals which are not connected to each other will be at least 3 mm in length; and electrically connecting selected ones of said terminals that are not said longer terminals to selected ones of said longer terminals in said m rows by inserting conductors in said maze.

* * * * *